United States Patent [19]

Katayanagi

[11] 4,038,179

[45] * July 26, 1977

[54] HYDROCHLORIC ACID FLOTATION PROCESS FOR SEPARATING FELDSPAR FROM SILICEOUS SAND

[76] Inventor: Akira Katayanagi, No. 11-65, 3-chome, Sainokami, Yahatanishi, Kitakyushu, Japan, 806

[ * ] Notice: The portion of the term of this patent subsequent to Oct. 29, 1991, has been disclaimed.

[21] Appl. No.: 582,828

[22] Filed: June 2, 1975

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,483,192 | 9/1949 | Gieseke | 209/166 |
| 2,578,790 | 12/1951 | Duke | 209/166 |
| 2,633,241 | 3/1953 | Banks | 209/166 |
| 3,297,759 | 1/1967 | Curtiss | 260/570 D |
| 3,844,939 | 10/1974 | Katayanagi | 209/166 |

OTHER PUBLICATIONS

Chem. Abst. 69, 1968, 28956g.

*Primary Examiner*—Robert Halper
*Attorney, Agent, or Firm*—Brisebois & Kruger

[57] ABSTRACT

An improved process for the separation of feldspar from an ore containing feldspar and siliceous sand by means of froth flotation wherein a mixture of a petroleum sulfonate and an N-higher alkyl-alkylenediamine salt which may contain a higher alkylamine is used as a flotation reagent in the presence of hydrochloric acid. According to this improved process, feldspar with good quality can be separated by only one froth flotation treatment without the necessity of repeated treatments and troublesome adjustment to the conditions.

9 Claims, No Drawings

HYDROCHLORIC ACID FLOTATION PROCESS FOR SEPARATING FELDSPAR FROM SILICEOUS SAND

BACKGROUND OF THE INVENTION

This invention relates to an improved process for separating feldspar from siliceous sand, i.e. quartz sand, by means of froth flotation. More particularly, this invention relates to a process for effectively separating feldspar from siliceous sand by using a specific flotation agent under an acidic condition provided by hydrochloric acid.

Flotation, especially froth flotation, is well-known among the general mineral recovery processes such as magnetic separation processes in which usueful ore constituents are separated by utilizing a difference in the magnetic forces of the ore constituents and gravity concentration processes in which useful ore constituents are separated by utilizing a difference in the specific gravitites of the ore constituents.

In a conventional froth flotation process, feldspar has been separated from ores usually by pulverizing the ores into a proper particle range, classifying the particles according to size, subjecting them to an activation treatment with hydrofluoric acid, admixing them in water together with a collector (for example, an aliphatic amine) and a foaming agent (for example, pine oil), introducing air thereinto to cause bubbling, and recovering the feldspar in the froth or foam thus generated, while leaving other ore constituents, such as quarz, as tailings.

However, the hydrofluoric acid used as the activator in this process reacts violently with other substances due to its high reactivity. Further, the hydrofluoric acid is a highly poisonous reagent and therefore, must be handled with the greatest possible care. In addition, hydrofluoric acid has the disadvantage of attacking and dissolving the surface of the quartz with a reduction in the yield of the product. Because of these disadvantages and drawbacks, the use of this activator is not desirable in carrying out this process on a commercial scale.

With a view to overcoming these drawbacks caused by the use of hydrofluoric acid in the conventional separation processes, I already proposed a process for effectively separating feldspar from siliceous sand wherein froth flotation of ores is effected by using a combination of a higher aliphatic amine and a petroleum sulfonate as the flotation reagent in the presence of sulfuric acid (U.S Pat. No. 3,844,939). However, this sulfuric acid flotation process tends to entrain fine particles of siliceous sand in feldspar particles during the froth flotation treatment. Consequently, two treatments, i.e. the primary and secondary froth flotation treatments, are required to recover feldspar with good quality. In this process, some difficulty exists in adjustment of the concentration of sulfuric acid, the adjustment being necessary to prevent the precipitatin of an insoluble substnace formed by the reaction of sulfuric acid with the amine. Thus, this process still has shortcomings in practical use and there is a great demand for developing a practical and satisfactory process for effectively separating feldspar from siliceous sand by means of forth flotation.

BRIEF SUMMARY OF THE INVNETION

It is an object of the present invention to provide an improved process for efficiently separating feldspar from siliceous sand by froth flotation of feldspar-siliceous sand ores.

It is another object of the present invention to provide a process for separating feldspar from quartz sand by a single froth flotation treatment of the ores without the necessity of activation with hydrofluoric acid.

Further objects, features and advantages of the invention will become apparent from the following description.

DETAILED DESCRIPTION OF THE INVENTION

As a result of much research carried out for overcoming the drawbacks of the sulfuric acid flotation process, it has now been found that the separation of feldspar from siliceous sand can be attained in a high efficiency and in a single froth flotation treatment by substituting hydrochloric acid for sufluric acid and using a specific flotation reagent. The present invention has been accomplished on the basis of this finding.

In accordance with the present invention, there is provided a hydrochloric acid froth flotation process for separating feldspar from an ore containing feldspar and siliceous sand, which comprises pulverizing the ore into fine particles, suspending them in an aqueous solution of hydrochloric acid, adding to the suspension a flotation reagent composed of a petroleum sulfonate and an N-higher alkyl-alkylenediamine salt alone or in mixture with a higher alkylamine salt, blowing air into the suspension to produce froth and thereafter, recovering feldspar from the froth. According to the process of the present invention, feldspar can be separated from siliceous sand at a separation efficiency of at least 90%.

The petroleum sulfonate used as one component of the flotation reagent in the present invention is, for example, a salt such as sodium or potassium salt of a mixed olefinsulfonic acid of the general formula:

$$C_nH_{2n-10}SO_3H \text{ to } C_nH_{2n-6}SO_3H$$

wherein $n$ is an integer of 20–30.

The petroleum sulfonate is prepared by treating petroleum with concentrated sulfuric acid and preferably has a mean molecular weight of 400–500. Sodium salts are preferable and they are advantageously used in the form of a mixture.

The N-hihger alkyl-alkylenediamine salt used as the other component of the flotation reagent is, for example, a salt with an inorganic or organic acid of a diamine of the following general formula:

$$R—NH—A—NH_2$$

wherein R stands for an alkyl group having 15–25 carbon atoms and A for an alkylene group having 2–5 carbon atoms.

The N-higher alkyl-alkylenediamine salts are usually in the form of a mixture in which R and A stand for the various groups having different cabron atoms. This compound may be used alone or in mixture with a higher alkylamine salt. Examples of the higher alkylamine salt include inorganic or organic acid salts of higher alkylamines of the general formula:

$$R'—NH_2$$

wherein R'stands for an alkyl group having 15–25 carbon atoms.

A specific example of a mixture of the N-higher alkyl-alkyl-enediamine salt and the higher alkylamine salt is Duomin T (a product of Lion-Armour Co.) which is a preferable flotation reagent for the present invention.

Examples of inorganic and organic acids utilizable for preparing salts of such diamines and alkylamines include hydrohalic acids, especially hydrochloric acid, acetic acid, propionic acid, tartaric acid and succinic acid.

In the flotatin reagent, the proportion of the sulfonate component to the diamine component which may be the diamine salt per se or a mixture of the diamine salt and the alkylamine salt is in the range of 1:4 to 7:3 by weight. If the proportion is outside the defined range, the flotation rate of feldspar will be condsiderably lowered.

In practice of the process of the present invention, vegetable essential oils, cresolica acids, Du Pont foaming agents, Dowfroth, Frothol, MIBC foaming agents, Nikko-oil, Takasago-oi and the like are used as foaming agents. Especially preferable as such foaming agnets are those of a higher alcohol series or polyether series.

GENERAL DESCRIPTION OF PREFERRED EMBODIMENT

A preferred embodiment of the process of the process of the present invention will now be illustrated below.

A raw ore containing feldspar and siliceous sand, for example, Ataka feldspar (produced in Tagawa County, Fukuoka Prefecture, Japan) is pulverized to a particle size of 65–200 mesh. The pulverized ore is then suspended in water the pH value of which has been adjusted to 1.8–2.5 with hydrochloric acid. In this case, a pulp concentration within a range of 10–40% by weight is proper. Next, a flotation reagent composed of the pertroleum sulfonate and the N-higher alkyl-alkylenediamine salt alone or in mixture with the higher alkylamine salt is added to the suspension in an amount of 200–350 g per ton of the treating liquid, i.e. suspension. A foaming agent is then added to the suspension in an amount of 10–50 g per ton of the treating liquid. Air is blown into the suspension, under conditions usually adopted for froth flotation, to effect sufficient foaming and the resultant froth is separated from the tailings. Thus, feldspar and siliceous sand are obtained as froth and tailings, respectively, in a high separation efficiency. If the amount of the flotation reagent is increased, the resulting feldspar has a reduced content of $Al_2O_3$ and $Fe_2O_3$, although the yield of feldspar per se is increased. Therefore, the amount of the flotation reagent should be selected depending upon desired quality of the recovered feldspar and the separation efficiency.

According to the process of the present invention, safe operation is assured since hydrofluoric acid is not used and in addition, an offensive odor prevalent in pine oil is not present since pine oil is not used as the foaming agent.

The present invention has such advantages that the process is operable by only a single froth flotation treatment for obtaining feldspar with good quality and thus requires no additional or secondary froth flotation treatment in contrast with the sulfuric acid flotation process where such secondary froth flotation treatment is always required to obtain feldspar with good quality. It is an additional advantage of the present invention that since hydrochloric acid forms no precipitate with the diamine which is one component is very easy.

The process of the present invention will now be illustrated by examples which are intended to illustrate but not limit the scope of the presnt invention. Unless otherwise indicated, all percentages are by weight.

EXAMPLE 1

A raw ore containing 89.00% of $SiO_2$, 9.40% of $Al_2O_3$, 0.12% of $Fe_2O_3$ and 1.42% of other constituents was finely divided and a fraction of a size below 75 mesh was collected and washed with water. To the particulate ore was added an appropriate quantity of water to perpare a pulp having a concentration of 10%. The pH value of the pulp suspension was then adjusted to 2.0 by addition of hydrochloric acid. To the pulp were added 150 g of beef tallow amine acetate (Duomin T, a product of Lion-Armour Co., Japan) and 100 g of sodium petroleum sulfonate (a product of American Cyanamid Co., U.S.A. having a mean molecular weight of 465) per ton of the pulp. To the pulp were further added 30 g of polyethyleneglycol butylether (a foaming agent) per ton of the pulp. A froth flotation treatment was carried out in a usual manner for 10 minutes by blowing air into the ore suspension at a temperature of 12.5°—13.5° C. The resulting froth was then separated from the tailings. A mineral obtained as the froth was feldspar containing 67.70% of $SiO_2$, 18.00% of $Al_2O_3$, 0.28% of $Fe_2O_3$ and 13.66% of other oxides, while a mineral obtained as the tailings was siliceous sand containing 97.74% of $SiO_2$, 1.38% of $Al_2O_3$ and 0.05% of $Fe_2O_3$.

EXAMPLE 2

Using feldspar powder having a particle size of 65—200 mesh, a froth flotation treatment for determining the separation rate of feldspar was carried out in the same manner as described in Example 1 except that the proportion of the components in the flotation reagent was varied as tabulated under the following conditions:

Pulp concentration : 10% pH : 2

Gas blown into the suspension : air, thereby to make it clear that the separation rate of feldspar is remarkably increased in the case of using hydrochloric acid as compared with the case of using sulfuric acid and that an optimum proportion exists in a mixture of the petroleum sulfonate and the diamine salt. A result of this froth flotation treatment is shown in the following table.

Table

| Flotation reagent (g/ton) | | | Separation rate (%) | |
|---|---|---|---|---|
| Exp. No. | Duomin T | Sodium petroleum sulfonate | The process of the present invention | The sulfuric acid flotation process |
| 1 | 0 | 250 | 0 | 0 |
| 2 | 50 | 200 | 20.0 | 19.5 |
| 3 | 75 | 175 | 87.0 | 72.0 |
| 4 | 100 | 150 | 89.5 | 72.5 |
| 5 | 125 | 125 | 94.0 | 72.5 |
| 6 | 150 | 100 | 97.5 | 72.5 |
| 7 | 175 | 75 | 99.0 | 75.0 |
| 8 | 200 | 50 | 97.0 | 55.0 |
| 9 | 250 | 0 | 78.5 | 65.0 |

The above table evidently shows that the process of the present invention is extremely higher in the separation rate of feldspar than the sulfuric acid flotation process even if the same flotation reagent is used. This table also shows that the proportion of the petroleum sulfonate to the diamine salt should be in the range of 1:4 to 7:3 by weight to obtain a good result.

What is claimed is:

1. A hydrochloric acid froth flotation process for separating feldspar from an ore containing feldspar and siliceous sand, which comprises finely dividing said ore into fine particles, suspending said particles in an aqueous solution of hydrochloric acid, adding to said suspension a flotation reagent composed of a petroleum sulfonated and an N-higher alkyl-alkylenediamine salt alone or in mixture with a higher alkylamine salt, blowing air into said suspension to produce froth, and thereafter recovering fedlspar from said froth.

2. The process of claim 1, wherein said petroleum sufonate is a salt of a mixed olefinsulfonic acid of the general formula:

$$C_nH_{2n-10}SO_3H \text{ to } C_nH_{2n-6}SO_3H$$

wherein $n$ is an integer of 20–30.

3. The process of claim 1, wherein said N-higher alkyl-alkylenediamine salt is a salt with an inorganic or organic acid of a compound of the general formula:

$$R—NH—A—NH_2$$

wherein R stands for an alkyl group having 15–25 carbon atoms and A for an alkylene group having 2–5 carbon atoms.

4. The process of claim 1, wherein said higher alkylamine salt is a salt with an inorganic or organic acid of a compound of the general formula:

$$R'-NH_2$$

wherein R′ stands for an alkyl group with 15–25 carbon atoms.

5. The process of claim 1, wherein the proportion of said petroleum sulfonate to said N-higher alkyl-alkylenediamine salt alone or in mixture with said higher alkylamine in said flotation reagent is in the range of 1:4 to 7:3 by weight.

6. The process of claim 1, wherein said flotation reagent is composed of said petroleum sulfonate and a mixture of said N-higher alkyl-alkylenediamine and said higher alkyamine.

7. The process of claim 1, wherin said aqueous solution of hydrochloric acid has a pH value of 1.8 –2.5.

8. A process according to claim 1, wherein a foaming agent is added to said suspension in an amount of 10–50 g per ton of said suspension.

9. The process of claim 8, wherein said foaming agent is selected from the group consisting of vegetable essential oils, cresolic acids and higher alcohol series and polyether series foaming agents.

* * * * *